United States Patent [19]

Björklund

[11] 4,292,809

[45] Oct. 6, 1981

[54] PROCEDURE FOR CONVERTING LOW-GRADE THERMAL ENERGY INTO MECHANICAL ENERGY IN A TURBINE FOR FURTHER UTILIZATION AND PLANT FOR IMPLEMENTING THE PROCEDURE

[75] Inventor: Björn A. Björklund, Västerhaninge, Sweden

[73] Assignee: AB Svenska Fläcktfabriken, Fack, Stockholm, Sweden

[21] Appl. No.: 58,135

[22] Filed: Jul. 17, 1979

[30] Foreign Application Priority Data

Jul. 24, 1978 [SE] Sweden ..... 7808104

[51] Int. Cl.[3] ..... F01K 13/00; F01K 25/08; F25B 27/02

[52] U.S. Cl. ..... 60/676; 60/651; 62/238.4

[58] Field of Search ..... 60/651, 671, 676; 62/324 B, 238 C

[56] References Cited

U.S. PATENT DOCUMENTS

| | | | |
|---|---|---|---|
| 1,979,128 | 10/1934 | Watson | 60/671 |
| 2,952,138 | 9/1960 | Russell et al. | 60/671 |
| 3,194,026 | 7/1965 | Fleur | 62/238 C |
| 4,033,141 | 7/1977 | Gustafsson | 60/651 |
| 4,118,934 | 10/1978 | Brola | 62/238 C |
| 4,177,651 | 12/1979 | McFarland | 60/671 |

*Primary Examiner*—A. Michael Chambers

[57] ABSTRACT

This invention relates to a procedure for converting low-grade thermal energy into mechanical energy in a turbine for further utilization and a plant for implementing the procedure. The procedure according to the invention is characterized in that a low-grade heating medium and a first cooling medium are evaporated in a heat exchanger (A). The steam is carried to a turbine (T) for energy conversion and moist steam is carried from here to a heat exchanger (B) for condensing. The condensate is pumped back to the heat exchanger (A), i.e. the steam turbine circuit. Since the heat exchanger (B) is common to the steam turbine circuit described above and a heat pump circuit in such a manner that the heat exchanger comprises a condenser for the steam turbine circuit and an evaporator in the heat pump circuit, the heat removed in connection with condensing can be absorbed by a second evaporating cooling medium the steam of which is pumped via a heat pump (VP) to a heat exchanger (C) which is cooled by cooled medium from the heat exchanger (C) and where condensing takes place. The condensate is carried via an expansion valve (Ex) back to the heat exchanger (B) while outgoing cooled medium from the heat exchanger (A) is either heated in its entirety to a lower level than the original temperature at the commencement of the process or else a partial flow is reheated to a level that is equal to or higher than the original temperature at the commencement of the process and returned to the heat exchanger (A). The purpose of the invention is to provide a procedure and a plant for the conversion of low-grade heat in the form of cooling water or waste heating water from a process of any kind or hot water occurring in nature into mechanical energy in a turbine for further utilization.

12 Claims, 2 Drawing Figures

PROCEDURE FOR CONVERTING LOW-GRADE THERMAL ENERGY INTO MECHANICAL ENERGY IN A TURBINE FOR FURTHER UTILIZATION AND PLANT FOR IMPLEMENTING THE PROCEDURE

The present invention relates to a procedure for converting low-grade thermal energy into mechanical energy in a turbine for further utilization and plant for implementing the procedure.

The purpose of the invention is to achieve a process and a plant for converting low-grade heat, e.g. in the form of cooling water or waste heating water from a process of any kind or hot water occurring in nature, into mechanical energy in a turbine for further utilization, whereby a heat exchanger is common in the invention's two-stage procedure steam turbine circuit—heat pump circuit—condenser in the steam turbine circuit and evaporator in the heat pump circuit.

The procedure and the plant according to the invention are characterized by what is evident from the appended claims.

Figure 1:
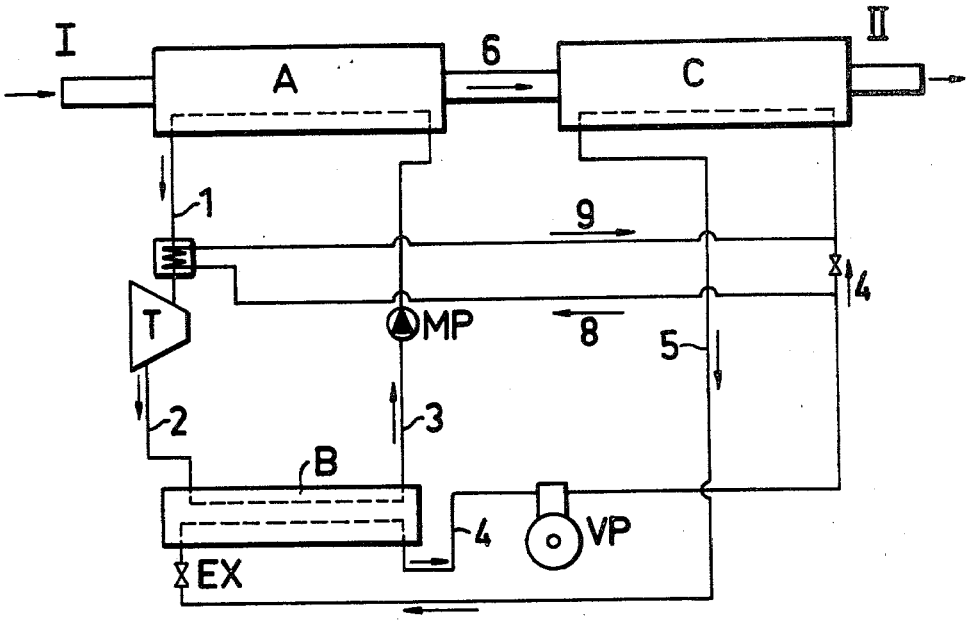
Figure 2:
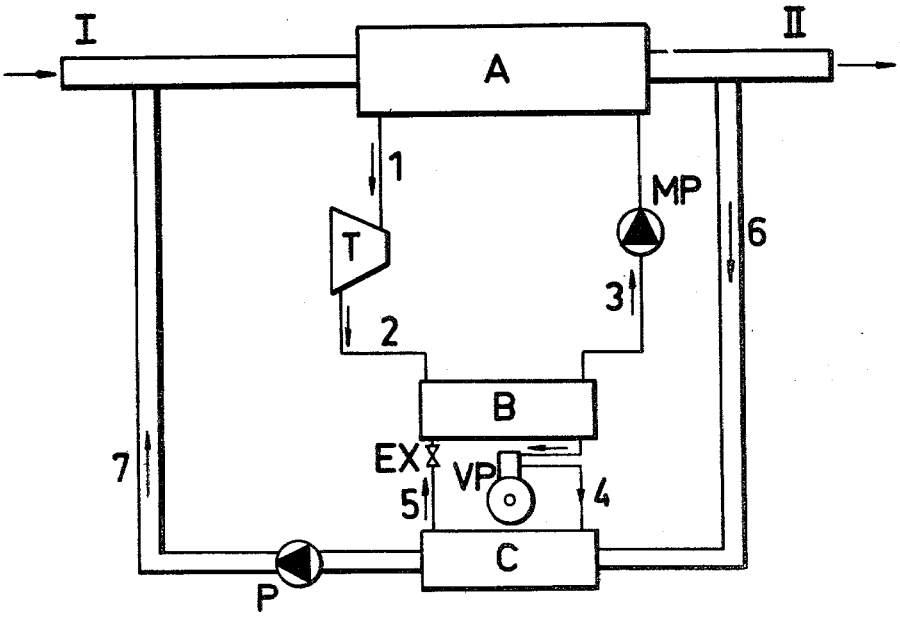

The invention will now be described in greater detail with reference to appended drawings in which FIG. 1 shows a diagram of the plant according to the invention with total outgoing cooled medium flow and FIG. 2 shows a diagram of the same plant but with partial outgoing cooled medium flow.

FIG. 1 refers to a plant where low-grade heating medium 1, e.g. in the form of cooling water or waste heating water from a process of any kind, is carried to a heating device A where it evaporates a first cooling medium of suitable type. Heating device A consists of a heat exchanger functioning as a steam generator but which also functions as a cooler of the low-grade heating medium. The evaporated cooling medium is carried by pipe 1 to a turbine for energy conversion, i.e. the thermal energy of the steam is converted partially into another energy state via a generator, for example. From turbine T the moist steam is now carried in pipe 2 to a first cooling device B for condensing. The first cooling device B for condensing. The first cooling device B consists of a heat exchanger equipped with an evaporator but also serves as a condenser in the process. The condensate formed during cooling is pumped via a feed pump MP through pipe 3 back to heat exchanger A and the process, i.e. a work cycles, has been completed. The feed pump is driven either directly by a turbine or by an electric motor. The heat removed during condensing is absorbed by a second evaporating cooling medium of suitable type in heat exchanger B. The evaporated cooling medium is pumped via a heat pump VP, installed in order to obtain a higher condensing temperature, through pipe 4, i.e. a heat pump circuit. The heat pump is driven either directly by a turbine or by an electric motor. Condensing subsequently takes place in a second cooling device C. The second cooling device C consists of a heat exchanger functioning as a condenser. Heat exchanger C is cooled by outgoing cooled medium 6 from heat exchanger A. The condensate formed during cooling is carried via an expansion valve Ex through pipe 5 back for further utilization in heat exchanger B. The hot gas of heat pump VP can be utilized for extra superheating of the ingoing first evaporated cooling medium supplied to turbine T and circulates back and forth in the process through pipes 8 and 9. The outgoing cooled medium 6 from heat exchanger A is heated in heat exchanger C in its entirety to a level that is lower than the original temperature level at the commencement of the process. From heat exchanger C the heating medium 11, e.g. cooling water or waste heating water, then goes back to the used process.

FIG. 2 refers to a similar plant but of somewhat different design. The steam turbine cycle is the same but the heat pump circuit is not. Only part of the flow of outgoing cooled medium 6 from heat exchanger A is reheated but to a level that is the same as or higher than the original temperature level at the commencement of the process and then returned via a pump P through pipe 7 to heat exchanger A. Through the combination of steam turbine and heat pump circuit, a sufficiently low condensing temperature is achieved to enable the steam turbine circuit to function.

The invention is of course not limited to these versions but can naturally be varied within the framework of the concept of the invention.

I claim:

1. A method for converting low-grade thermal energy into mechanical energy in a turbine for further utilization, comprising evaporating a first cooling medium in a heating device by means of a low-grade heating medium coming from outside, carrying the evaporated steam from said heating device to at least one turbine for energy conversion, following which the moist steam leaving said turbine is carried to a first cooling device for condensing, pumping the condensate via a feed pump back to the heating device, the heat removed during condensing being absorbed by a second evaporating cooling medium, the steam of which created thereby is pumped via at least one heat pump in order to obtain a higher condensing temperature, after which condensing is caused to take place in a second cooling device which is cooled by outgoing cooled medium from the heating device, carrying the condensate via an expansion valve back to the first cooling device while outgoing cooled medium from the heating device is heated in its entirety to a level lower than the temperature level at the entrance of the heating device.

2. A method for converting low-grade thermal energy into mechanical energy in a turbine for further utilization, comprising evaporating a first cooling medium in a heating device by means of a low-grade heating medium coming from outside, carrying the evaporated steam from said heating device to at least one turbine for energy conversion, following which the moist steam leaving said turbine is carried to a first cooling device for condensing, pumping the condensate via a feed pump back to the heating device, the heat removed during condensing being absorbed by a second evaporating cooling medium, the steam of which created thereby is pumped via at least one heat pump in order to obtain a higher condensing temperature, after which condensing is caused to take place in a second cooling device which is cooled by outgoing cooled medium from the heating device, carrying the condensate via an expansion valve back to the first cooling device while a part of the outgoing cooled medium is reheated to a level that is at least the same as the original temperature level at the entrance of the heating device and then returned to the heating device.

3. A method according to claim 1 or 2, wherein the low-grade heating medium is selected from the group consisting of cooling water, waste heating water, and hot water occurring in nature.

4. A method according to claim 1 or 2, wherein the heating device comprises at least one heat exchanger functioning as a steam generator.

5. A method according to claim 1 or 2, wherein the first cooling device comprises at least one heat exchanger equipped with an evaporator.

6. A method according to claim 1 or 2, wherein the heat pump is driven directly by the turbine.

7. A method according to claim 1 or 2, wherein the heat pump is driven directly by an independent motor.

8. A method according to claim 1 or 2, wherein the hot gas of the heat pump superheats the steam supplied to the turbine.

9. A method according to claim 1 or 2, wherein the second cooling device comprises at least one heat exchanger functioning as a condenser.

10. A plant for converting low-grade thermal energy into mechanical energy, comprising:

a heating device, a turbine, a first and a second cooling device, and at least one heat pump, and an expansion valve; first conduit means for passing a low-grade heating medium through said heating device; second conduit means for passing fluid heated by said first heating means through said turbine, said first cooling device for condensing, and for passing the resultant condensate back to said heating device; and third conduit means for passing a cooling medium having absorbed heat in said first cooling device through said at least one heat pump and said second cooling device for condensing and via said expansion valve back to said first cooling device; said first conduit means also passing through said second cooling device, at least part of said low-grade heating medium after having passed through said first heating device passing through said second cooling device.

11. A plant according to claim 10, wherein the heating device and the first and second cooling devices are heat exchangers.

12. A plant according to claim 10, comprising fourth conduit means for passing hot gas of the heat pump to means associated with said second conduit means for extra superheating the fluid supplied to the turbine.

* * * * *